US006608255B1

(12) United States Patent
Donner et al.

(10) Patent No.: US 6,608,255 B1
(45) Date of Patent: Aug. 19, 2003

(54) LOCAL AREA NETWORK CABLING ARRANGEMENT HAVING IMPROVED CAPACITANCE UNBALANCE AND STRUCTURAL RETURN LOSS

(75) Inventors: Daryle Pat Donner, Council Bluffs, IA (US); Harold Wayne Friesen, Dunwoody, GA (US); David R. Hawkins, Sugar Hill, GA (US); Stephen Taylor Zerbs, Gretna, NE (US)

(73) Assignee: Avaya Technology Corp., Basking Ridge, NJ (US)

( * ) Notice: Subject to any disclaimer, the term of this patent is extended or adjusted under 35 U.S.C. 154(b) by 789 days.

(21) Appl. No.: 08/861,481

(22) Filed: May 22, 1997

(51) Int. Cl.[7] ..... H01B 7/00

(52) U.S. Cl. ..... 174/110 R; 174/113 R; 174/27

(58) Field of Search ..... 174/27, 110 R, 174/36, 113 R, 110 BR

(56) References Cited

U.S. PATENT DOCUMENTS 4,873,393 A * 10/1989 Friesen et al. ..... 174/34
5,493,071 A * 2/1996 Newmoyer ..... 174/113 R
5,519,173 A * 5/1996 Newmoyer et al. ..... 174/113 R
5,527,996 A * 6/1996 Ham ..... 174/113 R
5,606,151 A * 2/1997 Siekierka et al. ..... 174/113 R
5,767,441 A * 6/1998 Brorein et al. ..... 174/27

OTHER PUBLICATIONS

U.S. patent application Pending, Ser. No. 08/808901, "Local Area Network Cabling Arrangement," Friesen, et al., Case Friesen 12–2–12, filed Feb. 28, 1997.

* cited by examiner

*Primary Examiner*—William H. Mayo, III
(74) *Attorney, Agent, or Firm*—Thomas, Kayden, Horstemeyer & Risley, LLP

(57) ABSTRACT

A cabling media which is suitable for high performance data transmission includes a plurality of insulated metallic conductor-pairs, each pair including two plastic insulated metallic conductors which are twisted together. More specifically, the introduction of a periodic rotation along the length of each insulated conductor essentially acts to cancel out a large number of the adverse effects which may result due to a lack of conductor concentricity and/or dielectric eccentricity.

12 Claims, 2 Drawing Sheets

LOCAL AREA NETWORK CABLING ARRANGEMENT HAVING IMPROVED CAPACITANCE UNBALANCE AND STRUCTURAL RETURN LOSS

TECHNICAL FIELD

This invention relates to an improved local area network cabling arrangement. More specifically, it relates to a particular cable design which includes a plurality of metallic conductors which are rotated about their axis prior to being twisted with another conductor to form a conductor-pair. Such insulated conductor rotation (ICR) significantly lowers the pair-capacitance unbalance to ground and structural return loss of the resulting cable by improving the effective concentricity and dielectric eccentricity of the conductors.

BACKGROUND OF THE INVENTION

Along with the greatly increased use of computers for offices and for manufacturing facilities, there developed a need for a cable which may be used to connect peripheral equipment to mainframe computers and to connect two or more computers into a common network. Of course, given the ever-increasing demands for increased data transmission rates and improved quality, the sought-after cable desirably should not only provide substantially error-free transmission at relatively high bit rates or frequencies but also satisfy numerous other elevated operational performance criteria.

Not surprisingly, of importance to the design of metallic-conductor cables for use in local area networks are the speed and the distances over which data signals must be transmitted. In the past, this need had been one for interconnections operating at data speeds up to 20 kilobits per second and over a distance not exceeding about 150 feet. This need was satisfied with cables which may comprise a plurality of insulated conductors that were connected directly between a computer, for example, and receiving means such as peripheral equipment. Currently, cable, generally identified throughout the industry as Category 3 products, is commercially available that can effectively transmit up to 16 MHz data signals and a series of products designated as Category 5 provide the capability of effectively transmitting up to 100 MHz data signals.

The objectives being demanded by cable customers, including local area network (LAN) vendors and distribution system vendors, are becoming increasingly stringent. This is true for both the breadth of the types of features demanded as well as the technical wherewithal necessary to accomplish the new requests from customers. In this regard, further advances in the operational performance of LAN cables are becoming increasingly difficult.

The unshielded twisted pair has long been used for telephone transmission in the balanced (differential) mode. Over the past several years, some LAN designers, have come to realize the latent transmission capability of unshielded twisted pair cable. Especially noteworthy is the twisted pair's capability to transmit rugged quantized digital signals as compared to corruptible analog signals.

In an attempt to enhance the operational performance of twisted pair cables, manufacturers have employed a variety of different twist schemes. As used herein, twist scheme is synonymous with what the industry sometimes calls twinning or pairing schemes. In general, twist scheme refers to the exact length and type/lay of twist selected for each conductor pair. More specifically, in one such twist scheme particularly described in commonly-assigned U.S. Pat. No. 4,873,393 issued in the names of Friesen and Nutt and which is hereby expressly incorporated by reference, it is stated that the twist length for each insulated conductor pair should not exceed the product of about forty and the outer diameter of the insulation of one of the conductors of the pair. While this is just one example of an existing approach for defining a twist scheme which results in an enhanced cable design, many others exist.

As a more recent piece of prior art, the reader's attention is drawn to a unique twist scheme set forth in commonly-assigned patent application filed in the names of Friesen, Hawkins and Zerbs on Jan. 31, 1997 and which is expressly incorporated by reference herein. This document describes a particular series of conductor-pair twist lengths that when used together in a single cable provide operational performance values that significantly surpass the transmission requirements for cables qualifying as Category 5 cables under TIA/EIA-568A. Another commonly-assigned application of interest was filed on Feb. 28, 1997 in the names of Friesen, Hawkins and Zerbs and directed to a cable design that provides significant enhancement in the balance of insertion loss and characteristic impedance from one conductor-pair to other conductor-pairs, and which is also expressly incorporated by reference herein.

Notwithstanding the aforementioned problems and solutions, there still appears to be a need for a cable that satisfies the criteria discussed above and also addresses the need for communication cables, particularly LAN cables, having improved capacitance unbalance and structural return loss characteristics. Notably, capacitance unbalance and structural return loss are becoming increasing targets for improvement as the other operational characteristics are enhanced by ongoing technical development as mentioned above. As a result, the factors that contribute to less than desirable capacitance unbalance and structural return loss values are being evaluated. In particular, the present invention focuses on concentricity and eccentricity of the metallic conductor and its dielectric insulation to develop a technique for compensating for any such problems that may exist in order to improve the capacitance unbalance and structural return loss values of the resulting cable.

SUMMARY OF THE INVENTION

The foregoing problems have been overcome by a cabling arrangement of this invention which includes a first conductor-pair including two insulated metallic conductors twisted together with a predetermined first twist length, and at least one additional conductor-pair including two insulated metallic conductors twisted together with a predetermined second twist length different than the first twist length of the first conductor-pair. Most notably, in accordance with the present invention, at least one of the individual conductors has been rotated about its central axis at a predetermined rate of revolution prior to being combined with another conductor to establish a conductor-pair. This insulated conductor rotation (ICR) significantly improves the capacitance unbalance and structural return loss characteristics of the resulting cable.

In an alternative embodiment, the present invention is directed to a communication cable comprising a plurality of insulated conductors surrounded by a sheath system that includes a plastic jacket said conductors being formed into one or more separate units by twisting pairs of the conductors together at a predetermined twist rate, wherein at least one of the separate units comprises at least one conductor that individually rotates about its central axis at a predetermined rotation rate.

BRIEF DESCRIPTION OF THE DRAWING

Other features of the present invention will be more readily understood from the following detailed description of specific embodiments thereof when read in conjunction with the accompanying drawings, in which.

DETAILED DESCRIPTION

Figure 1A:
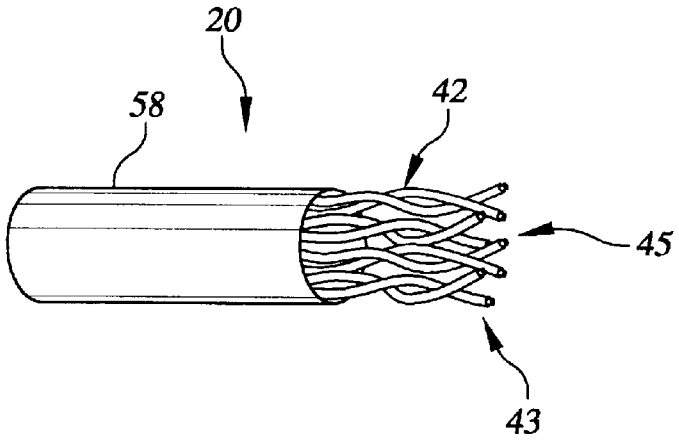
FIGS. 1*a* and 1*b* are perspective views of two embodiments, one shielded and one unshielded, of a cable of this invention for providing substantially error-free data transmission over relatively long distances.
Figure 1B:
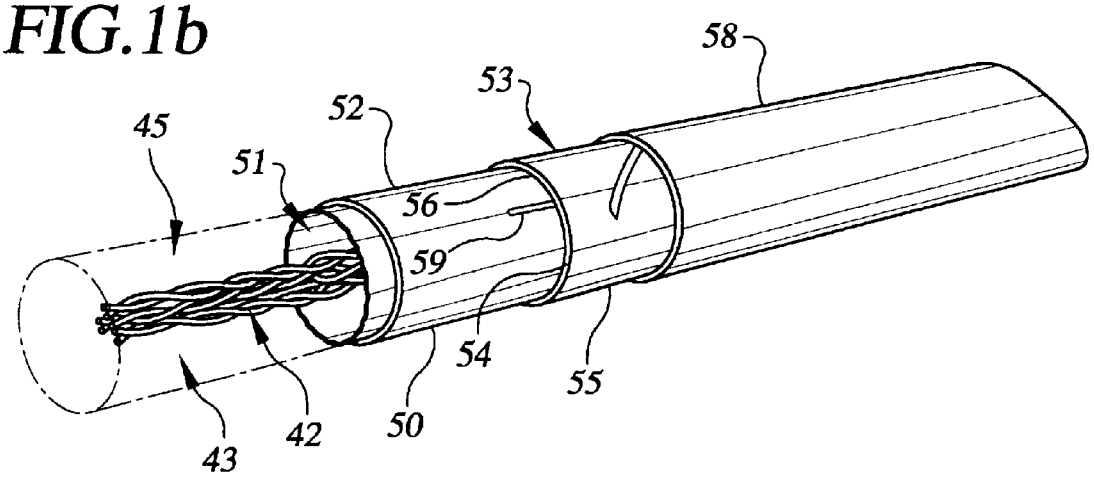

Referring now to FIGS. 1*a* and 1*b*, there are shown two embodiments of a data transmission cable which is designated generally by the numeral 20. Specifically, FIG. 1*a* depicts an unshielded embodiment and FIG. 1*b* depicts a shielded version of the present invention. While the difference between these two embodiments shown resides in the sheath system, it should be understood that the focus of the present invention is the particular selection and use of individual transmission media that have been rotated about their axis prior to establishing the conductor-pairs, which is equally applicable to both embodiments.

Figure 2:
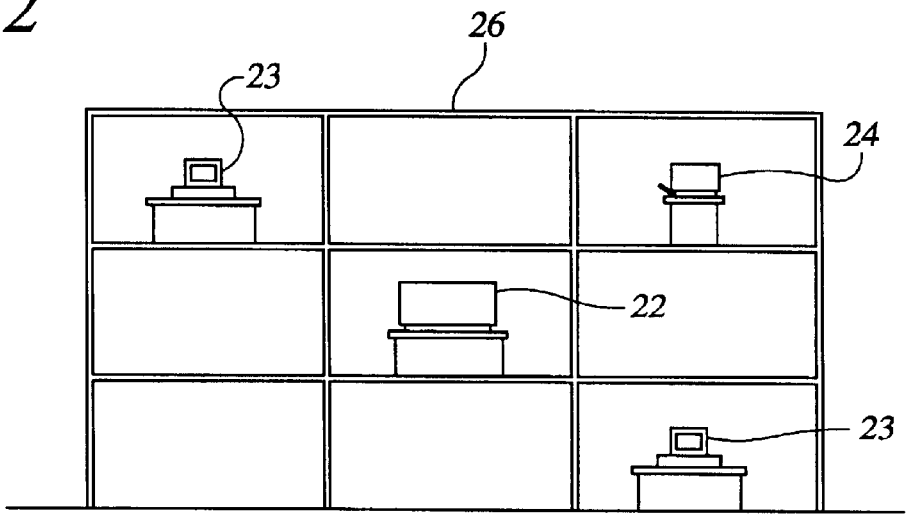
FIG. 2 is an elevational view of a building to show a mainframe computer, personal computers and peripherals linked by the cable of this invention.

Typically, the cable 20 is used to network one or more mainframe computers 22—22, many personal computers 23—23, and/or peripheral equipment 24 on the same or different floors of a building 26 (see FIG. 2). The peripheral equipment 24 may include a high speed printer, for example, in addition to any other known and equally suited devices. Desirably, the interconnection system minimizes interference on the system in order to provide substantially error-free transmission.

Further, there is a generally-accepted requirement that the outer diameter of the cable 20 not exceed a predetermined value and that the flexibility of the cable be such that it can be installed easily. The cable 20 has a relatively small outer diameter, i.e. in the range of about 0.1 inch to 0.5 inch, and is both rugged and flexible thereby overcoming the many problems encountered when using a cable with individually shielded pairs. The resulting size of the cable depends on a variety of factors including the number of conductor pairs used as well the type of sheath system selected. The particular cable of the preferred embodiment of the present invention recites the inclusion of four conductor-pairs within the cable design. However, while the cable 20 of the present invention may, in fact, include any number of conductors, even a single conductor-pair, it is noted that present industry desires appear to call for from two and twenty-five pairs of insulated conductors within a single cable.

While the general cable structure and envisioned application described above may relate to any number of high performance communication cable designs, the particular advantages of the present invention over the prior art is attributable to the novel teaching of the present invention that purposely rotating the individual insulated metallic conductors prior to combining that conductor with another conductor to establish a conductor-pair, significantly enhances the operational performance of the cable. Throughout this document, the aspect described immediately above may be referred to as insulated conductor rotation (ICR).

In general, it is recognized herein that capacitance unbalance and structural return loss are both functions of at least two parameters of the insulated conductors, as referred to herein these are conductor concentricity and dielectric eccentricity. However, given the present state of the insulation technology and the increased manufacturing speeds that are apparently becoming essential to employ, it has become very difficult to make further improvements in these particular insulated conductor parameters.

In accordance with the present invention, ICR is an effective way of nulling out, or averaging out, the eccentricity in a conductor. As noted above, ICR is the rotation of a conductor about its center axis with a given period spanning some length of the conductor. In a preferred embodiment of the present invention, the particular period, length or lay of such rotation should be less than the period, at the highest reference frequency, of a signal waveform being carried by the conductor.

In support of the pronouncement made herein that in incorporation of ICR significantly improves the capacitance unbalance and structural return loss of the resulting cable, it may be beneficial to consider specifically what is happening inside of a conductor during one period of ICR. As described herein, the metallic conductor will revolve about its center axis and complete one full circuit during conductor rotation. In practice, the center of this circuit acts as the center axis of the conductor. As a result, an electrical signal traversing the length of the rotated conductor will 'feel' a wire that for all purposes appears to be perfectly concentric. In other words, a conductor-pair made of conductors that have been rotated in accordance with the teachings of the present invention is essentially identical from an operational perspective to a conductor-pair made of conductors each having perfect concentricity, or zero eccentricity.

The quantified amount of ICR is determined by the following mathematical relationship:

$$ICR = \left(\frac{tl}{rl}\right) \times 100$$

where tl is the notation for the twist length in inches and rl is the notation for the length or period of rotation for that conductor in inches.

It should be noted that the present invention specifically contemplates having the direction of rotation of a conductor be in a direction opposite the direction of twist for the resulting conductor-pair containing that conductor as well as having the conductor's rotation be in the same direction as the direction of that pair's twist.

As eluded to above, the preferred embodiment of the present invention sets forth an effective length of rotation that is less than one wavelength of the signal to be transmitted along a particular carrier. More specifically, given the preferred twist scheme as set forth in the two commonly-assigned applications referenced earlier in the Background hereof, the optimum ICR length selected based on current technical, as well as economic considerations, is about a 5 inch lay. Thus, given that different conductor-pairs have different twist lengths, the use of a predetermined lay length, or the period of rotation, for an insulated conductor causes each of the conductor-pairs to exhibit a different percentage of ICR. For example, if all of the conductors have an ICR of 5 inches, a conductor-pair with a 0.440 inch twist length exhibits an 8.8% ICR, whereas a conductor-pair with a 0.410 twist length exhibits an 8.2% ICR, a conductor-pair with a 0.596 twist length exhibits an 11.92% ICR, and a conductor-pair with a 0.670 twist length exhibits a 13.4% ICR. In other words, by specifying a certain ICR length, a different percentage of ICR is applied to each conductor-pair. However, the novel ICR aspects of the present invention may also be applied so as to vary the rotational rates between various conductors within a given pair.

From an operational standpoint, ICR may provide at least the following advancements to existing communication cable designs: 1.) lower pair-capacitance unbalance to ground by 8 pf/100 meters on average; 2.) raise pair SRL Margin by 6 dB, to the range of about a 9 dB minimum guaranteed SRL Margin within Category 5 type applications; 3.) raise the minimum insertion loss margin to the Category 5 Loss Spec by 0.9% (1% when rounding); 4.) raise NEXT Margin by 1.5 dB on average in a pair; and 5.) reduce the SRL level resulting from periodic conductor imperfections that may significantly degrade the SRL value otherwise.

ICR in accordance with the present invention can be accomplished by a number of means. One such technique involves using a vertical twister commonly used to twist two insulated conductors into a conductor-pair. More specifically, in order to implement ICR, a single insulated conductor is processed through the vertical twister with an opposite rotation as compared to when two insulated conductor are processed to form a conductor-pair in the conventional manner. Depending on the particular manufacturing set-up of the particular twister at hand, various mechanical adjustments may need to be made; however any such adjustments are believed to be fully within the capabilities of one of ordinary skill in the art and therefore are not specifically discussed herein. As noted above, other existing equipment may also be suitable to implement ICR in accordance with the present invention, including but not limited to horizontal twisters.

For the purposes of illustrating at least two preferred embodiments of this invention, the particular material used as the insulation is varied. In particular, examples are set forth herein for both cable designs having a highly flame-retardant material, such as fluorinated ethylene propylene (FEP), as the insulation for plenum cable applications, as well as other less flame retardant materials, such as high-density polyethylene (HDPE), for cable designs for use in non-plenum and/or non-halogen qualifying applications. It is understood that many other known materials classified as fluoropolymers and polyolefins may also be used as appropriate insulation materials in accordance with the present invention. As can be seen from the tables below, the choice of different insulation materials changes the optimum values for insulation thickness for a given metallic conductor size. Therefore, regardless of the type of insulation material selected, implementing the teachings described herein, namely varying the size of the metallic conductor and/or the insulation thickness of various conductor-pairs within a single cable, is deemed to be within the scope of the present invention.

The particular examples of a preferred embodiment given herein utilize the unique twist scheme set forth in commonly-assigned patent application filed in the names of Friesen, Hawkins and Zerbs on Jan. 31, 1997, mentioned in the Background of the Invention above and expressly incorporated by reference herein. More specifically, the targeted twist lengths for four conductor-pairs as set forth in the application mentioned immediately above are 0.440, 0.410, 0.596, and 0.670 inches when the size of the conductors used are 24 gage. However, neither the particular twist lengths, nor the specific conductor size, selected are the crux of the present invention, but instead are provided as examples only.

Figure 3:
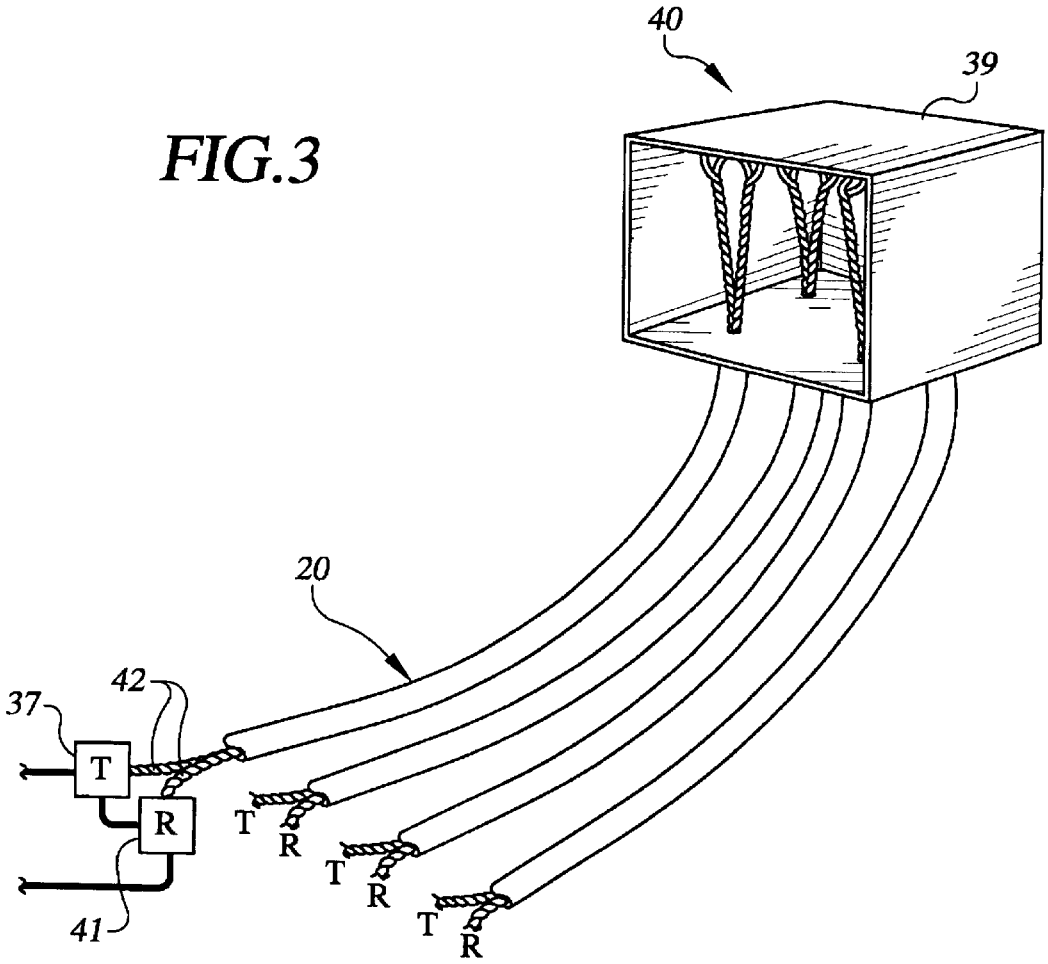
FIG. 3 is a view of a data transmission system which may include the cable of this invention.

Referring now to FIG. 3, there is shown an example system 40 in which the cable 20 of this invention is useful. In FIG. 3, a transmitting device 37 at one station is connected along a pair of conductors 42—42 of one cable to an interconnect hub 39 and then back out along another cable to a receiving device 41 at another station. A plurality of the stations comprising transmitting devices 37—37 and receiving devices 41—41 are connected to the interconnect hub 39 and then back out along another cable to a receiving device 41 at another station. A plurality of the stations comprising transmitting devices 37—37 and receiving devices 41—41 may be connected to the interconnect hub in what is referred to as a ring network. As can be seen in this example, the conductors are routed from the transmitting device at one terminal to the hub 39 and out to the receiving device at another terminal, thereby doubling the transmission distance.

Figure 4:
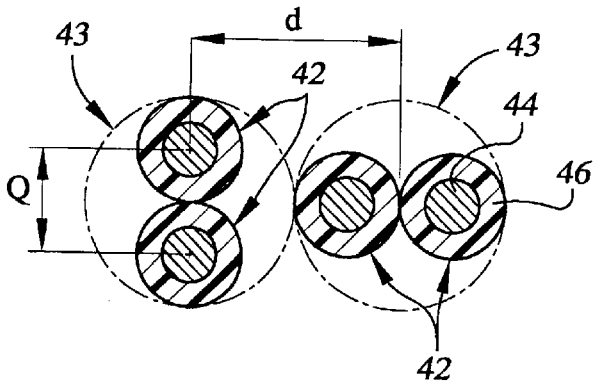
FIG. 4 is a cross-sectional view of two pairs of insulated conductors as they appear in a cable of this invention.

More particularly, the cable 20 of this invention includes a core 45 comprising a plurality of twisted pairs 43—43 of the individually insulated conductors 42—42 (see FIGS. 1*a*, 1*b* and 4) which are used for data transmission. Each of the insulated conductors 42—42 includes a metallic portion 44 (see FIG. 4) and an insulation cover 46. In a preferred embodiment, the insulation cover 46 may be made of any fluoropolymer material, such as TEFLON, or polyolefin material, such as polyethylene or polypropylene. Furthermore, the outer jacket 58 (see FIGS. 1*a* and 1*b*) may be made of a plastic material such as polyvinyl chloride, for example.

It should be noted that the present invention may be used in the design of either a shielded or an unshielded cable. In particular, FIG. 1*a* illustrates an unshielded cable design while FIG. 1*b* depicts a shielded cable design. The difference between the two designs resides only in the sheath system selected for the given application and is not viewed to be the crux of the present invention. However, for completeness, both the shielded and the unshielded embodiments are set forth herein.

In a shielded embodiment, the core 45 is enclosed in a sheath system 50 (see FIG. 1*b*). The sheath system may include a core wrap 51 and an inner jacket 52 which comprises a material having a relatively low dielectric constant. In the shielded version, the inner jacket 52 is enclosed in a laminate 53 (see FIG. 1*b*) comprising a metallic shield 54 and a plastic film 55 and having a longitudinally extending overlapped seam 56. A drain wire 59, which may be a stranded or a solid wire, is disposed between the shield 54 and the inner jacket 52. The metallic shield 54 is enclosed in an outer jacket 58 which comprises a plastic material such as polyvinyl chloride, for example.

The absence of individual pair shielding overcomes another objection to prior art cables. The outer diameter of the insulation cover 46 about each metallic conductor is small enough so that the insulated conductor can be terminated with standard connector hardware.

The two embodiments described above, shielded and unshielded, are believed to be the most common form of cabling media to employ the present invention. However, other forms of communication transmission may be within the scope of the present invention. For example, the plurality of pairs may be disposed side by side in a wiring trough and not be enclosed in a plastic jacket or any other type of common sheath system as yet another embodiment of the present invention. While the particular embodiments shown herein are round in design, it is noted that the attributes of the present invention could also be realized by other cable design regardless of their shape.

In addition to the particular type of sheath system used in accordance with the novel insulated conductor aspects of the present invention, the materials for the conductor insulation and/or the jacket(s) may be such as to render the cable flame retardant and smoke suppressive. For example, those materials may be fluoropolymers. Underwriters Laboratories has implemented a testing standard for classifying communications cables based on their ability to withstand exposure to heat, such as from a building fire. Specifically, cables can be either riser or plenum rated. Currently, UL 910 Flame Test is the standard that cables are subjected to prior to receiving a plenum rating. It is intended that the preferred embodiment of the present invention use materials for the jacket and/or conductor insulations such that the cable qualifies for a plenum rating. To achieve such a plenum rating, any number of the known technologies may be incorporated into a cable exhibiting the other specific attributes touted and claimed herein. Even given the aforementioned preference, it should be understood that a cable made in accordance with the present invention does not require such attention to or benefits from the jacketing and insulation material selected. In other words, the novel aspects of the present invention are equally applicable to non-plenum, as well as plenum environments. In fact, other particular testing standards and/or requirements may be applied and used to qualify cables incorporating the attributes of the present invention depending on the specific environment into which the cable is going to be placed. In this regard, it should be understood that cables incorporating the novel ICR aspects of the present invention may be made from halogen as well as non-halogen materials.

The characterization of the twisting of the conductors of each pair is important for the cable of this invention to provide substantially error-free transmission at relatively high bit rates. However, the particulars of the various twist schemes used to date to enhance the performance of a LAN cable will not be specifically addressed herein. Instead, the reader's attention is directed to the prior art identified earlier, each of which is expressly incorporated by reference herein. Regardless of which, if any, aspects of these previously described twist schemes is employed, incorporation of the teachings of the present invention will significantly enhance the operational performance of the resulting cable.

In addition to the specific design factors discussed above, a number of other factors must also be considered to arrive at a cable design which is readily marketable for such uses. The jacket of the resulting cable should exhibit low friction to enhance the pulling of the cable into ducts or over supports. Also, the cable should be strong, flexible and crush-resistant, and it should be conveniently packaged and not unduly weighty. Because the cable may be used in occupied building spaces, flame retardance also is important.

The data transmission cable should be low in cost. It must be capable of being installed economically and be efficient in terms of space required. It is not uncommon for installation costs of cables in buildings, which are used for interconnection, to outweigh the cable material costs. Building cables should have a relatively small cross-section inasmuch as small cables not only enhance installation but are easier to conceal, require less space in ducts and troughs and wiring closets and reduce the size of associated connector hardware.

Cable connectorability is very important and is more readily accomplished with twisted insulated conductor pairs than with any other medium. A widely used connector for insulated conductors is one which is referred to as a split beam connector. Desirably, the outer diameter of insulated conductors of the sought-after cable is sufficiently small so that the conductors can be terminated with such existing connector systems.

Further, any arrangement proposed as a solution to the problem should be one which does not occupy an undue amount of space and one which facilitates a simplistic connection arrangement. There is a need to provide cables that can transmit data rates of up to gigabits per second, error-free, from stations to closets or between computer cabinets separated by comparable distances to main rooms, be readily installed, fit easily into building architectures, and be safe and durable.

It should be understood that the above-described arrangements are simply illustrative of the invention. Other arrangements may be devised by those skilled in the art which will embody the principles of the invention and fail within the scope and spirit thereof.

What is claimed is:

1. A cabling media comprising:

two individual insulated metallic conductors twisted together with a predetermined first twist length to form a first conductor pair;

two individual insulated metallic conductors twisted together with a predetermined second twist length different than the first twist length of the first conductor-pair to form a second conductor pair;

wherein at least one of the individual conductors in each of the first conductor-pair and the second conductor-pair has been rotated about its central axis at a predetermined rate of revolution prior to being twisted with another conductor to establish a conductor-pair;

wherein the twist length, defined as the length per rotation of the individual conductors of one of the conductor-pairs is essentially the same as the twist length of the individual conductors of another conductor-pair and the twist length of both the first and second conductor-pairs is about five inches lay length;

wherein the two twisted conductor-pairs having the shortest twist lengths are positioned diagonal relative to each other; and a sheath collectively surrounding the conductor-pairs.

2. The cabling media of claim 1 wherein the twist length, defined as the length per rotation of the individual conductors, of both the first conductor-pair and the second conductor-pair is less than one wavelength of signals being transmitted there-across.

3. The cabling media of claim 1 wherein a ratio of the twist length, defined as the length per rotation for the individual conductors, of the first conductor pair to the twist length of a selected conductor-pair is different from a similar twist length ratio between the first conductor pair and a third similarly configured conductor-pair within the cable.

4. The cabling media of claim 3 wherein the ratio of the length per rotation for the individual conductors to the twist length of any conductor-pair is different from that ratio as calculated for any other conductor-pair within the cable.

5. The cabling media of claim 1 wherein a direction of rotation of the individual conductors of the first conductor pair is opposite a direction of twist establishing the first conductor-pair.

6. The cabling media of claim 1 wherein a direction of rotation of the individual conductors of the first conductor pair is the same as a direction of twist establishing that conductor-pair.

7. The cabling media of claim 1 wherein there are four pairs of metallic conductors.

8. The cabling media of claim 1 wherein the metallic conductors are 24 AWG.

9. The cabling media of claim 1 wherein the cabling media includes a jacket that is made of a material with flame retardant and smoke suppression properties.

10. The cabling media of claim 9 wherein the flame retardant and smoke suppression properties of the jacket and conductor insulation are sufficient to allow the cable to pass a criteria of the UL 910 Flame Test.

11. The cabling media of claim 1 wherein the insulation of the metallic conductors is made of a material with flame retardant and smoke suppression properties.

12. A cabling media comprising:

two individual insulated metallic conductors twisted together with a predetermined first twist length to form a first conductor-pair;

two individual insulated metallic conductors twisted together with a predetermined second twist length different than the first twist length of the first conductor-pair to form a second conductor-pair, and wherein the individual conductors of the second conductor pair are twisted in a same direction as the individual conductors of the first conductor pair are twisted;

two individual insulated metallic conductors twisted together with a predetermined twist length to form a third conductor-pair;

wherein at least one of the individual conductors in each of the first conductor-pair and the second conductor-pair has been rotated about its central axis at a predetermined rate of revolution prior to being twisted with another conductor to establish a conductor-pair;

wherein the two conductor-pairs having shortest twist lengths are positioned diagonal relative to each other; and a sheath collectively surrounding the conductor-pairs.

* * * * *